United States Patent [19]

Bart

[11] 4,423,565

[45] Jan. 3, 1984

[54] BUBBLE-BLOWING DEVICE WITH VARYING AIR FLOW PRESSURE

[75] Inventor: Philip D. Bart, Coral Springs, Fla.

[73] Assignee: M & B Toys, S.A., Colon, Panama

[21] Appl. No.: 219,143

[22] Filed: Dec. 30, 1980

[51] Int. Cl.[3] ..... A63H 33/28

[52] U.S. Cl. ..... 46/8

[58] Field of Search ..... 46/6, 7, 8

[56] References Cited

U.S. PATENT DOCUMENTS

| | | | |
|---|---|---|---|
| 2,452,794 | 11/1948 | Saachy | 46/8 UX |
| 2,547,825 | 4/1951 | King | 46/8 |
| 3,100,947 | 8/1963 | Hellman | 46/8 |
| 3,228,136 | 1/1966 | Rouse | 46/8 |
| 3,388,498 | 6/1968 | Greene | 46/8 |

FOREIGN PATENT DOCUMENTS

| | | | |
|---|---|---|---|
| 1509848 | 5/1978 | United Kingdom | 46/8 |

*Primary Examiner*—F. Barry Shay

*Attorney, Agent, or Firm*—Daniel M. Rosen

[57] ABSTRACT

A bubble blowing device generally in the form of a gun has a chamber for soapy-like fluid, a rotor with apertures which rotate one-by-one downward into the fluid and then upward to a discharge position, an electric blower with a nozzle for directing a flow of air to the fluid-filled aperture in the gun's discharge area, and drive means actuated by a trigger for rotating said rotor and energizing the blower to produce a stream of bubbles.

9 Claims, 8 Drawing Figures

FIG. 1
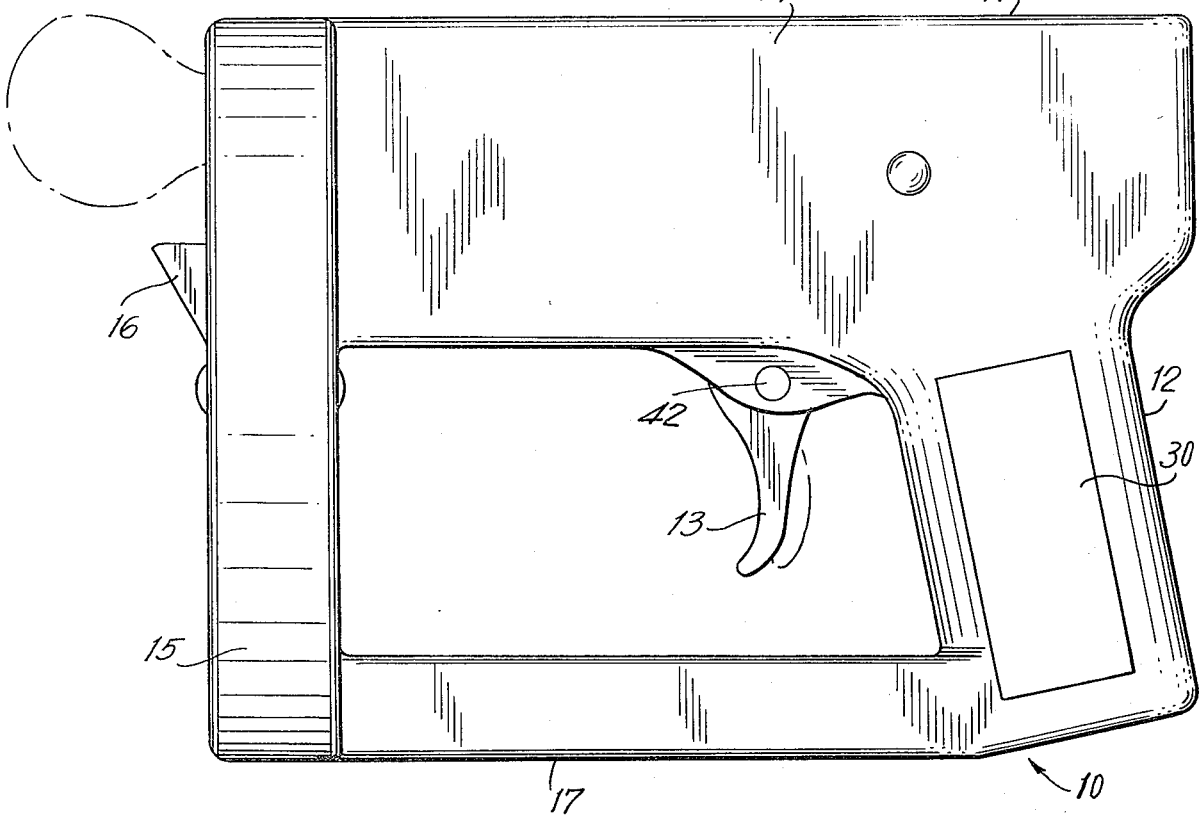
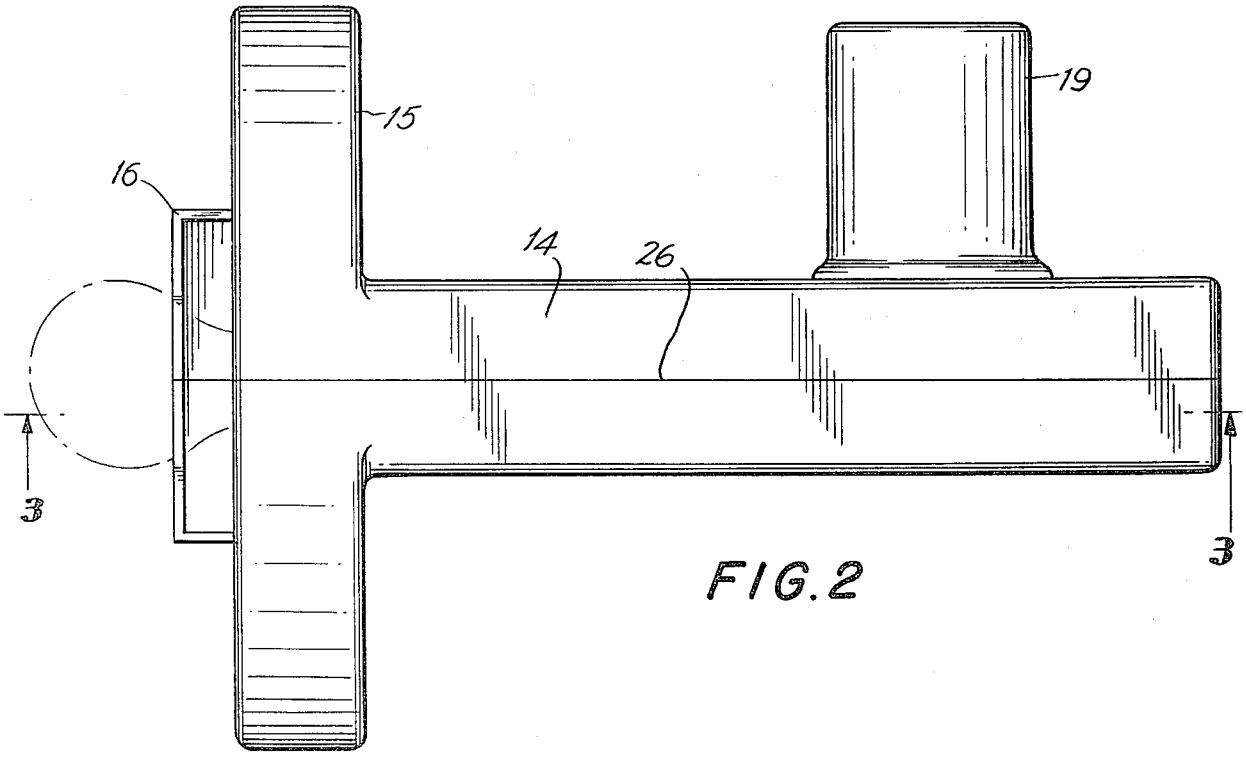
FIG. 2

FIG.3
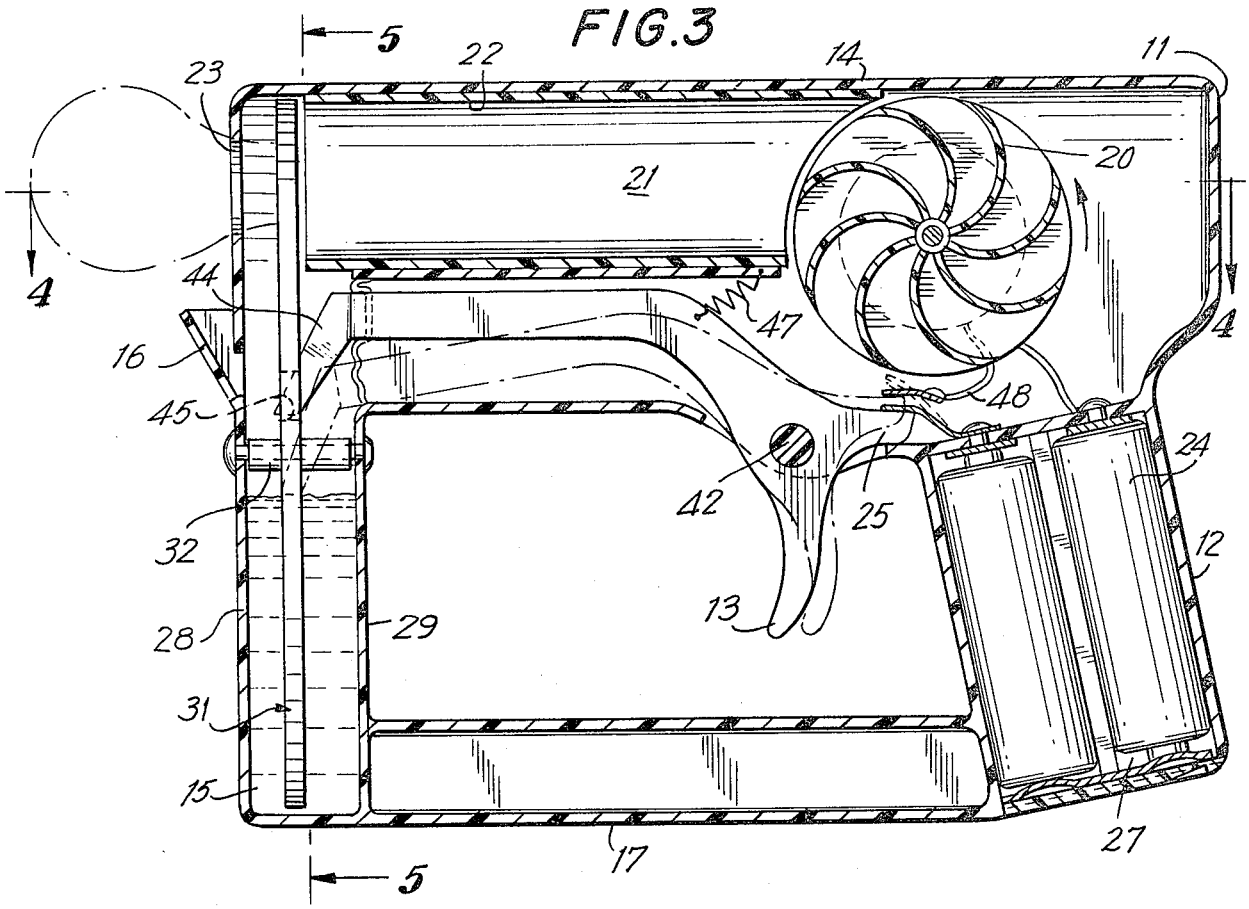
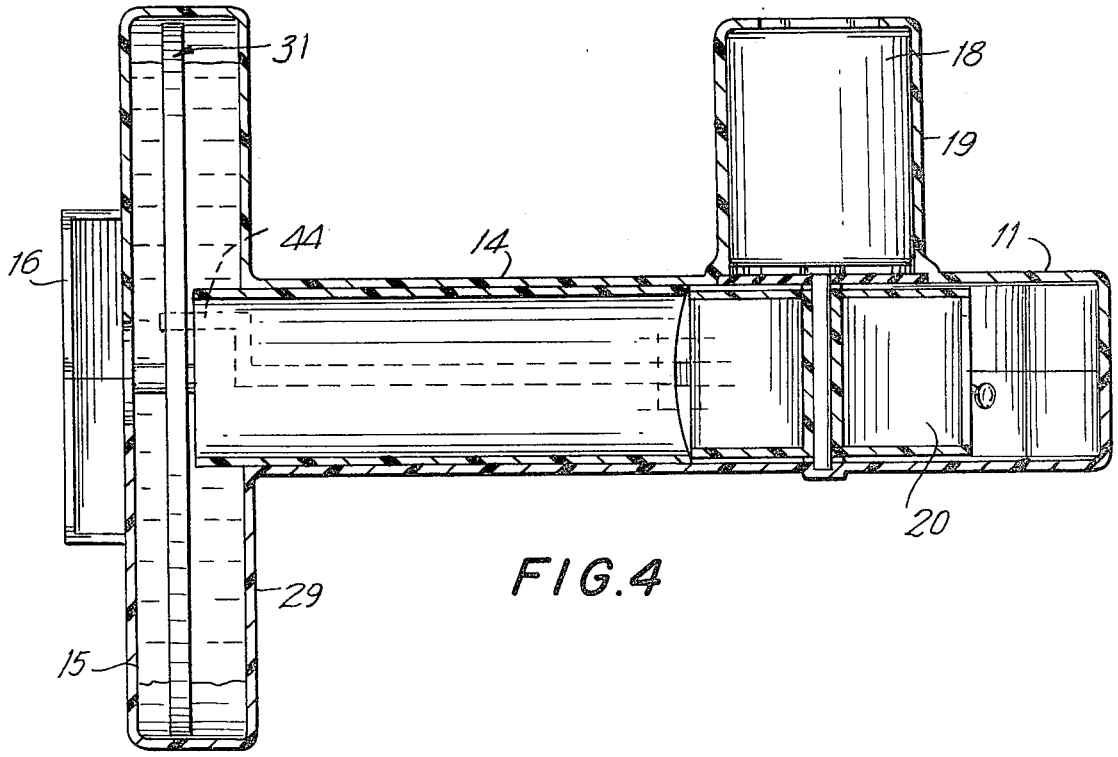
FIG.4

BUBBLE-BLOWING DEVICE WITH VARYING AIR FLOW PRESSURE

BACKGROUND OF THE INVENTION

This invention is in the field of bubble blowing devices which have been popular children's toys for many years. A typical bubble blower consists of a handle with a wire loop at one end defining a circular hole or aperture. To use this device the loop part is dipped into and then out of a soapy water solution with a resultant film of solution being formed across the entire aperture. In use the loop is placed near the child's mouth and a stream of air is blown at one side of the film, causing a stream of bubbles to be formed and blown out of the opposite side of the film. An alternate method of use is to swing the handle and film-filled loop through the air, which produces a similar resulting stream of bubbles.

In an examination of this known device and associated methods of use, it becomes apparent that the rate at which bubbles can be made and the quality of the bubbles depends upon factors like, how fast and how much air the user blows into the film or how fast the user swings the loop, how fast the user dips the loop into the solution and repositions the film-filled loop for bubble-making, how much energy the user has for this procedure, and other less personal factors like, the quality of the solution for its intended use, the temperature, humidity, and movement of the air into which the bubbles are formed and blown.

The present invention provides an automatic or a semi-automatic machine-gun type apparatus which forms and blows a huge number of bubbles at an extremely rapid rate that could not even be approached by an individual child using known prior art devices. The concepts and features of the new apparatus will be summarized briefly, followed by a detailed description of a preferred embodiment.

SUMMARY OF THE NEW INVENTION

A bubble blowing machine gun has a housing, a chamber within the housing for soapy-like fluid, and a rotor with apertures which rotate one by one downward into the fluid in the chamber and then upward to a discharge position. An electric blower has a nozzle for directing a flow of air to the fluid-filled aperture as it is rotated to the bubble-discharge area. An electric or manual drive mechanism actuated by the machine gun's trigger as a control means rotates the rotor and energizes the blower in a specifically timed relationship to produce a stream of a large number of bubbles in a very brief period of time. In one embodiment the blower is re-started with each trigger operation, thereby producing a cyclic air flow where pressure upon the fluid film builds up after the fluid-filled aperture is positioned, as contrasted with moving the fluid-filled aperture into a full power air stream. The apertures are located along a circular path about the rotor's axis, and the shape of each aperture is typically round.

A small flange or rib in the axial direction may be extended from the peripheral edge of each aperture which enables the aperture to hold a greater quantity of fluid and thereby produce a greater quantity of bubbles. Additional flanges may divide the rotor into pie-shaped sections for containing and segregating the fluid. Near the bubble discharge area at the front of the machine gun is a combination fill-funnel for receiving fluid into the chamber and drip collector to catch fluid drip at the conclusion of each bubble discharge.

In the functional sense in the new machine gun, a loop or apertured frame is dipped into or passed through a soapy-like fluid or in some other manner the fluid is caused to create a film or membrane filling the aperture. For example, a quantity of fluid can be directed to cyclicly fill the aperture that is stationary. Instead of a rotor, a single frame could be repeatedly dipped; however, the rotor has been found to provide a very rapid cycle time for successful production of a great number of bubbles. In this preferred embodiment this rotor is mechanically driven by each action of the trigger, but other mechanical or electrical means may by employed to revolve the rotor. The cyclic or variable air flow referred to above can be achieved not only with cyclic operation of the blower, but with a constant running blower and a cyclic interruption of the air stream. Still further variations are possible with a constant running blower in some relation to fluid-filled apertures cyclicly presented to the air stream.

The structural details of a preferred embodiment of this invention are illustrated in the appended drawings and explained in the description that follows.

DESCRIPTION OF THE DRAWINGS

FIG. 1 is a side elevation view of the new bubble-blowing device:

FIG. 2 is a top plan view thereof;

FIG. 3 is a sectional view taken along line 3—3 of FIG. 2.

FIG. 4 is a second sectional view taken along line 4—4 of FIG. 3.

DESCRIPTION OF THE PREFERRED EMBODIMENT

Figure 6:
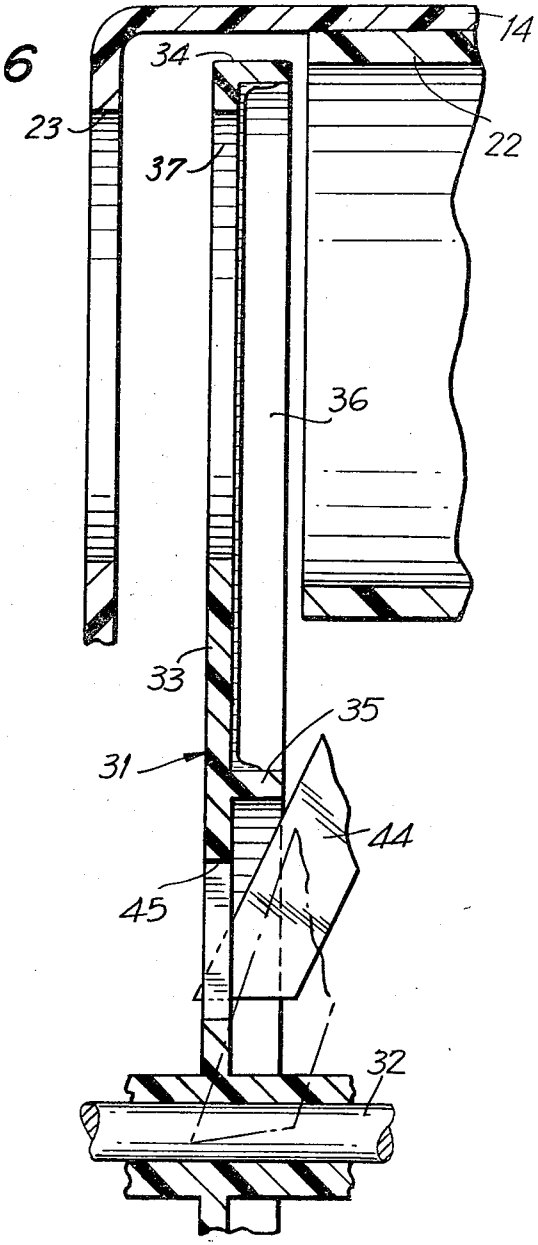
FIG. 6 is a fragmentary sectional view taken along line 6—6 of FIG. 5.

The new bubble-blowing machine gun 10 illustrated in the drawings has a housing 11 which incorporates a handle 12, a trigger 13, a barrel 14, a fluid chamber or reservoir 15, a fluid filling inlet 16, and a lower support beam 17.

The sectional views of FIGS. 3 and 4 illustrate the basic internal components of this device which are all mounted within housing 11. At the upper rear part of the housing near the handle an electric motor 18 is securely mounted and contained within a projecting part 19 of the housing. A squirrel-cage blower 20 is rotated by the motor, causing a stream of air 21 to flow axially in air discharge tube 22, which is part of barrel 14, toward outlet 23 in the housing. Batteries 24 in handle 12 are the power source for the motor, and trigger 13 has rear projection 25 which closes a switch means 48 to energize the battery-motor circuit to produce the air stream. It should be apparent that a great variety of motors and/or fans or complete blower subunits are possible so long as the proper air flow is provided. The power source shown is for a DC motor, which obviously is a convenient arrangement for a fully portable bubble-blowing machine gun; however, AC current or even a separate mechanical drive can be used with appropriate connections.

The housing 11 is conveniently formed of mating shells of injection; molded plastic with a parting line 26 extending axially as shown in FIG. 2. The housing 11 has various transverse walls illustrated in FIG. 3, which define battery chamber 27 in handle 12, and the fluid chamber 15 formed by front and rear walls 28 and 29 respectively. Batteries may be replaced via access panel 30 in handle 12.

Figure 8:
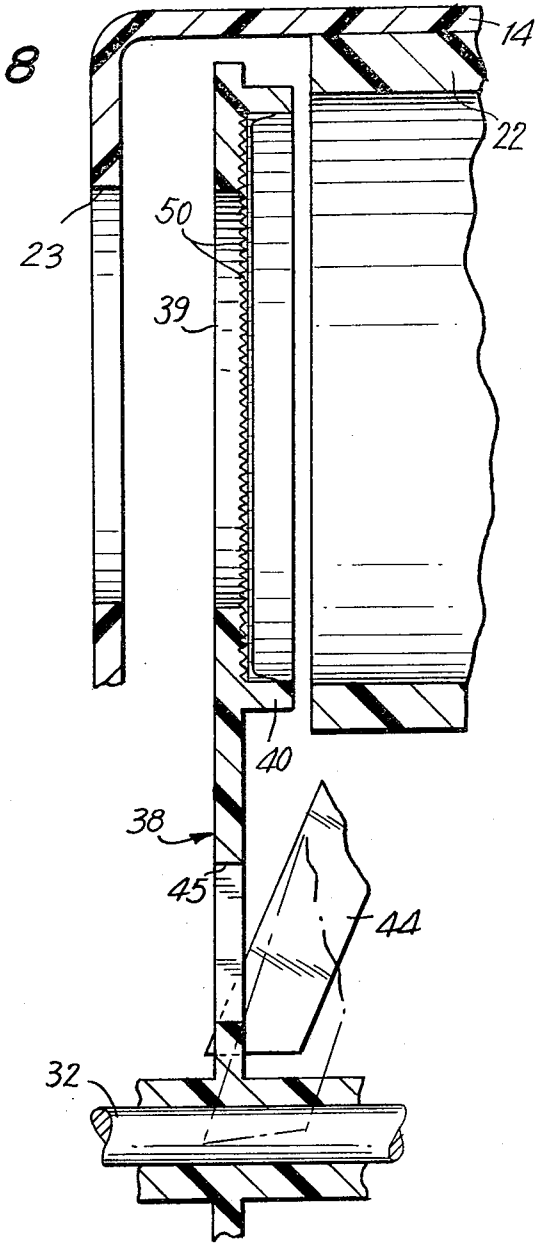
FIG. 8 is a sectional view taken along line 8—8 of FIG. 7.
Figure 7:
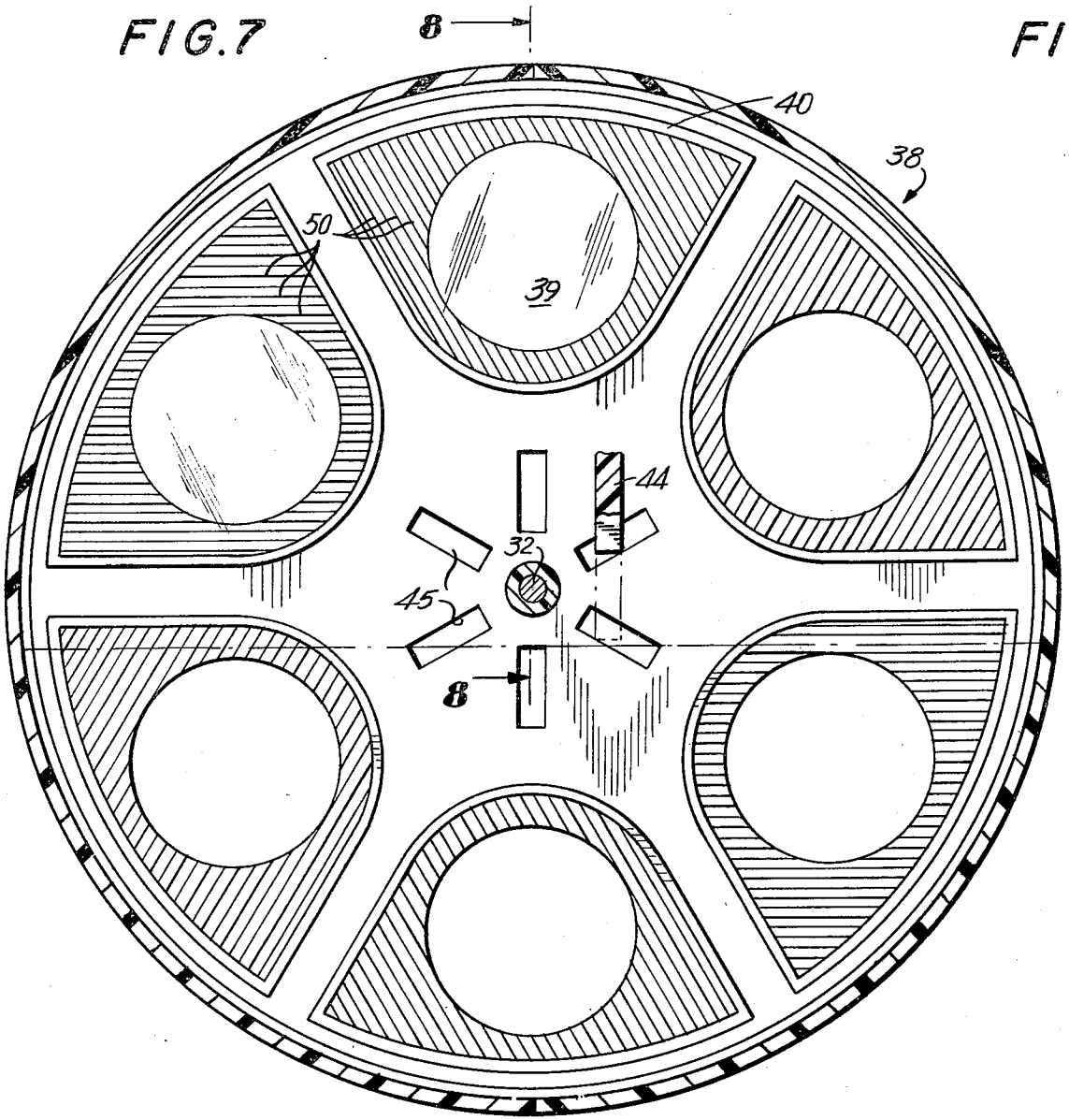
FIG. 7 is a front elevation view of a second embodiment of a rotor.

For actual bubble formation there is the rotor 31 shown in FIGS. 2–5 which has the form of a disc that rotates about its central axle 32, the ends of the axle being secured in walls 28 and 29 of the fluid chamber. Any other mounting for the rotor would be acceptable so long as the major part of the disc web and its apertures will dip into the fluid of the reservoir. The rotor preferably has six or eight pie-shaped sections 33, each bordered by a small axially extending flange. The flange, or rib, or rim is formed as an outer peripheral arc 34, an inner ring 35, and/or radial ribs 36, which are illustrated more particularly in FIGS. 5 and 6. The apertures 37 are shown as circles equally spaced on a circular path about and radially spaced from the axis of rotation; the apertures could be oval or a variety of other shapes. It is also possible to form a rim or rib completely around each aperture as shown in FIGS. 7 and 8, where rotor 38 has apertures 39 and circular ribs 40. The objective is to have the rotor section accociated with each aperture hold a large quantity of fluid and/or for the fluid to form a relatively thick membrane across the aperture, so that a very large number of bubbles can eventually be formed and blown from each aperture.

Figure 5:
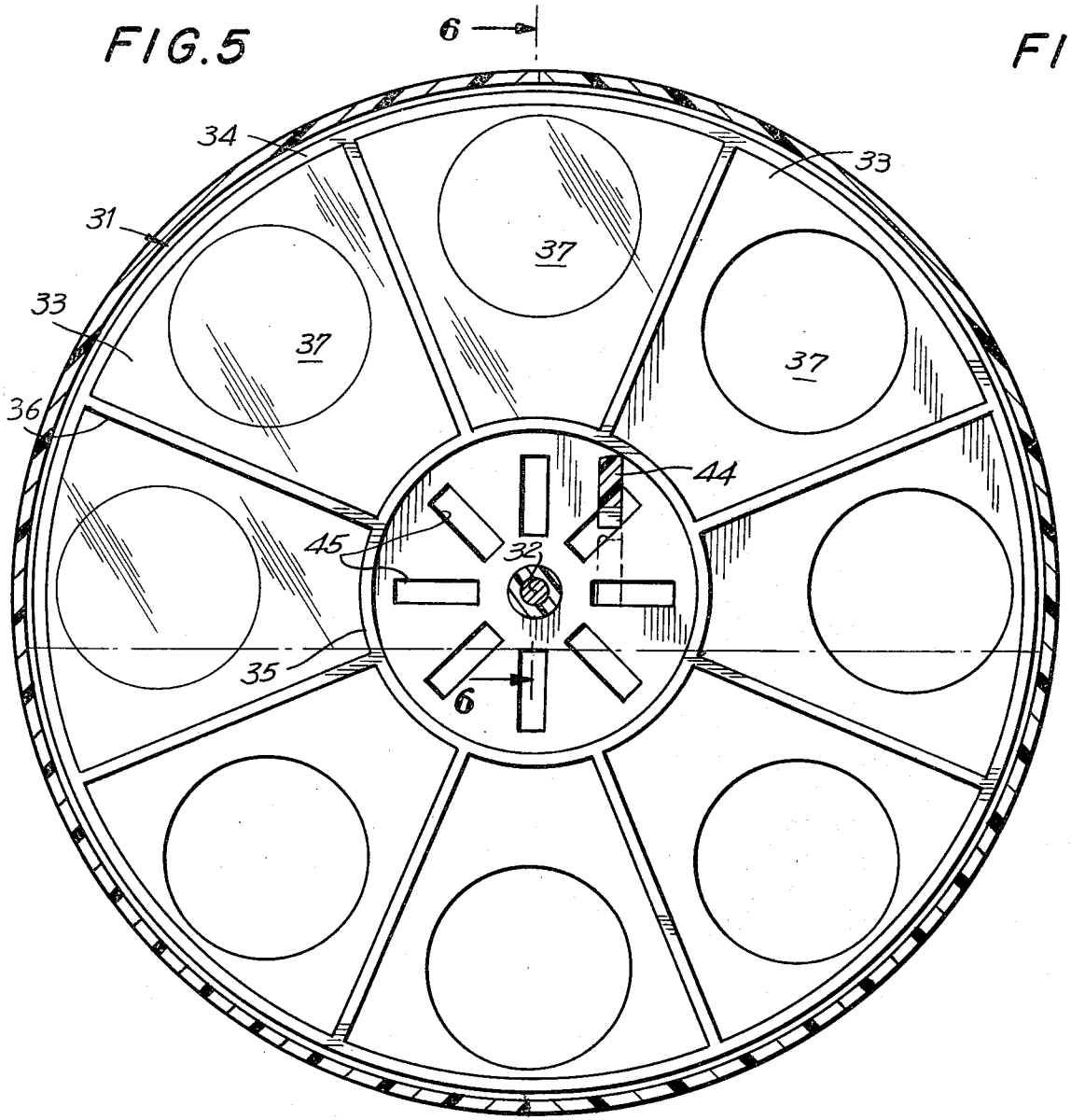
FIG. 5 is a third sectional view taken along line 5—5 of FIG. 3.

A rotor drive mechanism is provided to sequentially revolve the rotor one step or one aperture each time the trigger is pulled. The arrangement shown in FIGS. 3 and 5 is a simple mechanical drive or coupling where arm 41 extending from trigger 13 is pivoted about point 42 when trigger 13 is pulled rearward. This motion causes tip 44 of arm 41 to swing forward and downward into slot 45 and thence to drive rotor 31 counterclockwise (FIG. 5) until the next aperture moves into alignment with air discharge tube 22. Upon release of trigger 13, it is pulled back by spring 47 to its ready position, until the trigger is again pulled.

Adjacent the rear projection 25 of the trigger 13 is an electrical switch 48 which is closed by part 25 when trigger 13 is pulled. Upon closing of the switch from OFF to ON condition which in series connects the series-connected batteries to the blower motor 20, the blower motor 20 is energized from OFF to ON condition and a stream of air 21 begins to flow down tube 22. With this arrangement the air flow will have to build up from zero before the trigger 13 pulled to maximum or some lesser amount depending on how long the trigger is held depressed. Accordingly as the air stream 21 approaches the fluid membrane in the rotor aperture 37 which is aligned with the air discharge tube 22, also called in bubble position the lead air is moving slowly under only slight pressure. The air flow speed and pressure rapidly increase, and a stream of many bubbles is produced until the fluid of the membrane and in the rotor's ribbed section surrounding the aperture is so consumed that no more bubbles will form. When the trigger is released and then re-pulled, the rotor will again revolve one step, bringing a fresh fluid-filled aperture 37 into alignment with the air discharge tube 22.

This sequence of steps in the operation of the new bubble machine gun may be repeated until the fluid reservoir is so depleted that fluid membranes cease to form and fill the rotor apertures. In the preferred embodiment illustrated a very impressive number of bubbles in the range of 25 to 100 is formed with each trigger-operated sequence between its released and pulled positions. Two $1\frac{1}{2}$ volt batteries in series energize the blower motor, which operates at about 8000 revolutions per minute. The soapy fluid may be actual baby shampoo, liquid soap for typical home uses, bubble solution or other equivalent fluids. The rotor of this particular device has eight apertures each having a diameter of about $\frac{7}{8}$ inch. The ribs or rims or veins may define boundaries around each aperture or around a rotor web area larger than the aperture, but in which the aperture is situated, and/or the rim may simply extend along the outer peripheral edge. The height of such rims, ribs or veins extending transversely of the rotor web is in the range of 1/64 to $\frac{5}{8}$ inch. To add certain realism a noise-making element may be attached to the trigger or to the blower to simulate gunfire.

When using a rotor with eight apertures as shown in FIG. 5, and when one particular fluid-filled aperture is at top dead center, one adjacent fluid-filled aperture is above the mid-point of the rotor and thus is in air above the surface of fluid in the reservoir. Thus this "adjacent" fluid filled membrane is waiting to be rotated into alignment with air discharge tube 22, and during the waiting time fluid will tend to flow by gravity out of the aperture and out of the fluid zone associated with that aperture. It has been found that operation of this bubble machine gun will be very successful, if the trigger is pulled and released and re-pulled repeatedly at approximately-one-to three-second-intervals, to bring freshly filled fluid membranes to the air stream for optimal bubble production. Because of the many factors influencing bubble formation and bubble breakdown, especially including the particular soapy fluid selected and the size and power of the air stream, the optimal rate of trigger pulling will vary. The structure of the rotor may have variations, such as a roughened surface to slow drainage of fluid from the aperture or vane area; also the surface may have grooves 50 or protruding ribs or veins which are curved or lie in a direction other than down when the fluid-filled aperture is in waiting position above the fluid surface level, or in action, aligned for firing. This obviously will restrain the fluid from quickly flowing away, and thus will retain fluid to produce the maximum number of bubbles. The outer periphery rim on the rotor serves an additional purpose. When the reservoir level is low, perhaps too low to fully cover the bottom-most aperture, the rim can help the rotor scoop up enough fluid to flow into and fill the aperture.

One additional feature that was found useful in the embodiment and shown in FIG. 3 is locating the top aperture or orifice in the action position about $\frac{3}{8}$ inch inward from and aligned with the gun's housing outlet 23. It has been found that some bubbles will form from both apertures 37 and 23 simultaneously, which may provide support for bubbles during their formation.

A variety of structural equivalents to features of this invention are possible, all of which should be considered as within the spirit and scope of the invention as defined in the claims appended hereto.

I claim:

1. In a device for blowing bubbles, such device being operable with a soapy-like liquid and a source of electric current, the device including a housing, a reservoir in the housing for containing a quantity of said liquid, an electric blower carried by said housing and powered by said source of electric current, the blower further including a duct with an outlet opening for directing a stream of air and electrical switch means for turning said blower on and off, a bubble-forming element movably mounted on said housing and having a first part which defines therein at least one aperture, and drive means for moving said bubble forming element such that its first part moves downward into said reservoir and thence upward out of said reservoir for dipping said aperture into and out of any of said liquid in said reservoir, thereby forming a liquid membrane across said aperture, and thence for moving said first part and membrane into a bubble position adjacent said outlet opening and in the path of said stream of air, the improvement comprising control means actuating said switch means and blower to said on condition periodically when said first part and membrane are moved to said bubble position and actuating said switch means and blower to said off condition when said first part is moved away from said bubble position, said blower producing a stream of air having a particular air flow pressure during said on condition, and wherein said control means turns said blower on in a timed relationship with the movement of said bubble-forming element such that said stream of air will have an air flow pressure less than said continuous air flow pressure each time one of said apertures is initially moved to said bubble position, said housing further defining an outer orifice adjacent, downstream of and aligned with an aperture of said bubble-forming element when in its bubble position, said outer orifice having a diameter no less than the diameter of said aperture and being situated sufficiently close to said aperture at said bubble position to permit some of the bubbles at some time during the formation thereof to form simultaneously from said outer orifice and said aperture.

2. A device according to claim 1 wherein said drive means comprises a trigger movable between a pulled position and a released position, said trigger being coupled to said switch means and to said bubble forming element, whereby movement of said trigger to its pulled position drives said bubble forming element to said bubble position and actuates said switch means to said on condition.

3. A device according to claim 2 wherein said drive means further comprises spring means coupled to and urging said trigger to normally be in its released position, said trigger being movable against the spring means to its pulled position.

4. A device according to claim 3 wherein said housing comprises a toy gun with a handle adapted to be held in a person's hand and a trigger which is the trigger of said drive means as defined above.

5. A device according to claim 4 wherein said handle defines therein a receptacle and said source of electric current comprises a battery removably mounted in said receptacle.

6. A device according to claim 2 wherein said bubble-forming element is a rotor comprising a web rotatable about an axis therethrough, said web defining therein a plurality of apertures located on a circular path about and radially spaced from said axis, said rotor causing each of said apertures followed by its next adjacent aperture to be periodically dipped into said reservoir and subsequently moved to said bubble position.

7. A device according to claim 6 wherein said trigger is mechanically coupled directly to said rotor, whereby each movement of the trigger from its released to its pulled position rotates said rotor an amount sufficient to move said next adjacent aperture into its bubble position.

8. A device according to claim 7 wherein said trigger has a first part engaging said rotor and a second part engaging said switch means, whereby, upon movement of said trigger to its pulled position said first part rotates one of said rotor apertures to its bubble position and said second part actuates said switch means to its on condition.

9. A device according to claim 1 wherein said source of electric current comprises a battery carried by said device.

* * * * *